US005655765A

United States Patent [19]

Asami et al.

[11] Patent Number: 5,655,765

[45] Date of Patent: Aug. 12, 1997

[54] PAPER PATH SWITCHING MECHANISM USABLE WITH A PAGE INVERTER

[75] Inventors: Shinzi Asami, Saitama-ken; Yoshiaki Ushirogata, Tokyo-to; Hiroyuki Ishizaki, Nagoya; Minoru Hattori, Nagoya; Terumitsu Azuma, Nagoya, all of Japan

[73] Assignee: Ricoh Company, Ltd., Tokyo, Japan

[21] Appl. No.: 508,202

[22] Filed: Jul. 27, 1995

[30] Foreign Application Priority Data

Jul. 27, 1994 [JP] Japan ..... 6-175164

[51] Int. Cl.[6] ..... B65H 29/00

[52] U.S. Cl. ..... 271/185; 271/303; 271/902; 271/186

[58] Field of Search ..... 271/225, 184, 271/185, 186, 303, 902

[56] References Cited

U.S. PATENT DOCUMENTS

| | | |
|---|---|---|
| 4,762,312 | 8/1988 | Ushirogata . |
| 5,020,784 | 6/1991 | Asami et al. . |
| 5,186,446 | 2/1993 | Saeki et al. . |
| 5,232,210 | 8/1993 | Saeki et al. . |
| 5,362,200 | 11/1994 | Ushirogata . |

FOREIGN PATENT DOCUMENTS

| | | | |
|---|---|---|---|
| 0062146 | 9/1982 | Japan | 271/186 |
| 3-107454 | 11/1991 | Japan . | |
| 3-118964 | 12/1991 | Japan . | |
| 404116061 | 9/1992 | Japan | 271/186 |

*Primary Examiner*—H. Grant Skaggs

*Attorney, Agent, or Firm*—Oblon, Spivak, McClelland, Maier & Neustadt, P.C.

[57] ABSTRACT

A paper path switching mechanism including a plurality of feeding rollers which feed a page when the page is pressed against the feeding rollers by guide members of a switching guide. The switching guide has long guide members which press the paper against the feeding rollers and short guide members positioned near the edges of the page. The short guide members guide the page without imparting too much resistance at the edges of the page in order to reduce the frequency of paper jams. The longer guide members are tapered in width at portions near the periphery of the feeding rollers in order to reduce the size of the contact area of the page to the long guide members which reduces resistance on the page and consequently reduces paper jams. After the page passes between the switching guide and feeding rollers, its direction of travel is reversed and the page again contacts the switching guide but moves along a different edge of the guide members and along a different paper path in order to invert pages.

24 Claims, 7 Drawing Sheets

PAPER PATH SWITCHING MECHANISM USABLE WITH A PAGE INVERTER

BACKGROUND OF THE INVENTION

1. Field of the Invention

The present invention is related to a paper path switching mechanism which changes the paper path of a page, depending on the direction of travel of the page, and is more particularly related to a document inverting mechanism which changes the path of a page in order to reverse the front-to-back orientation of the page.

2. Discussion of the Background

In business office machines such as copiers, printers, and facsimile machines, it may be desirable to invert a page such that the top of the page is facing downwardly and the bottom of the page is facing upwardly. For example, when an automatic document feeder is used and original pages are first copied from the bottom of a paper stack, it may be desired to have the top and bottom of the pages inverted as compared to when pages of a book are copied from the front to the back of the book in order to have the pages ejected in the proper order and orientation. A known mechanism for inverting pages is disclosed in Japanese Published Patent Application 3-107454 (1991), a portion of which is illustrated in FIGS. 1A–1C. A mechanism similar to that illustrated in FIGS. 1A–1C is illustrated in Japanese Published Patent Application 3-118964 (1991). In FIG. 1A, a pair of rollers 201 and 202 feeds a page having the top-side T and under-side U past a diverter 205. In FIG. 1A, the diverter 205 directs the paper horizontally, past the diverter 210, and between the rollers 240. In contrast, when it is desired to invert the page, the diverter 205 pivots downwardly and directs the page around the roller 201, as illustrated in FIG. 1B. The page having the under-side facing upward and the top-side facing downwardly is then moved in a downward direction past the diverter 210, along path 230 and between the rollers 240. A view showing the length of roller 201 and the diverter 205 is illustrated in FIG. 1C.

Problems exist with the currently available page inverting mechanisms and document diverters in that paper jams sometimes occur due to the page diverters and document reversing mechanisms.

SUMMARY OF THE INVENTION

Accordingly, it is an object of the invention to have a paper path switching mechanism which reduces the number of paper jams. It is a further object of the invention to utilize the paper path switching mechanism with a page inverter.

These and other objects are accomplished by a paper path switching mechanism having a switching guide made of guide members which interact with a set of feeding rollers between which pages pass. When a page is traveling in a first direction, the page passes between the switching guide and feeding rollers. However, when the page is traveling in a second direction which is opposite to the first direction, the switching guide pivots about an axis in order to direct the page along a different paper path.

In order to prevent or reduce the number of paper jams which occur as the page is traveling past the switching guide, the switching guide includes shorter switching guides at positions which correspond to the ends of the page. In this manner, there is less pressure at the outer edges of the page which reduces the number of jams. Further, the longer guide elements making up the switching guide are tapered at the ends thereof in order to reduce the size of the contact area with the paper. The smaller contact area reduces the resistance caused by the switching guide which reduces the number of paper jams.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1A:
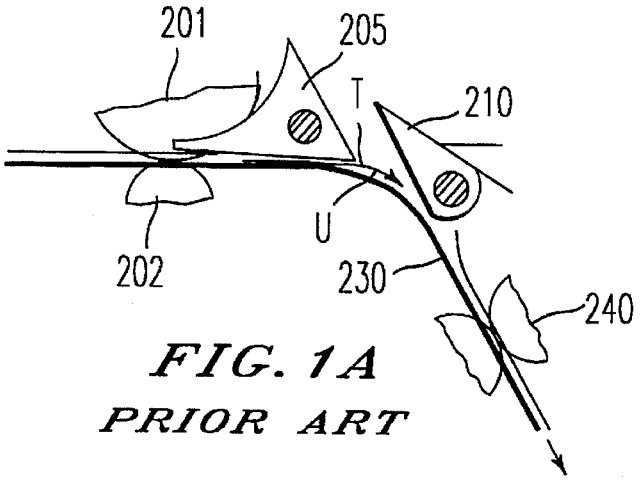
FIG. 1A PRIOR ART
FIGS. 1A–1C illustrate a portion of a conventional document inverting mechanism.
Figure 1B:
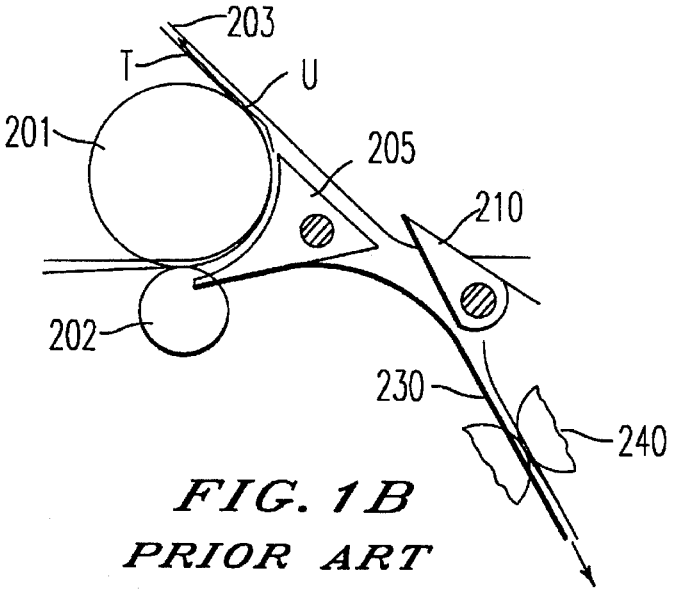
FIG. 1B PRIOR ART
Figure 1C:
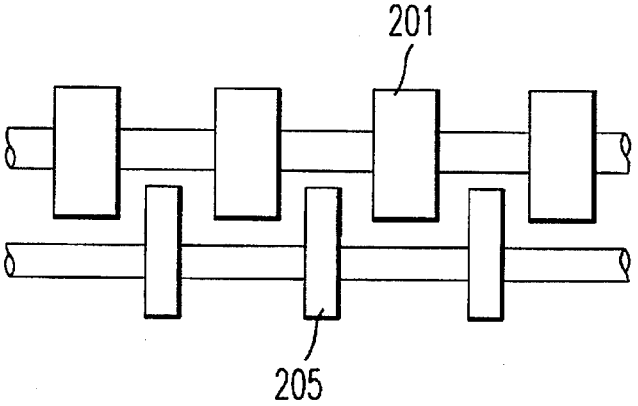
FIG. 1C PRIOR ART
Figure 2A:
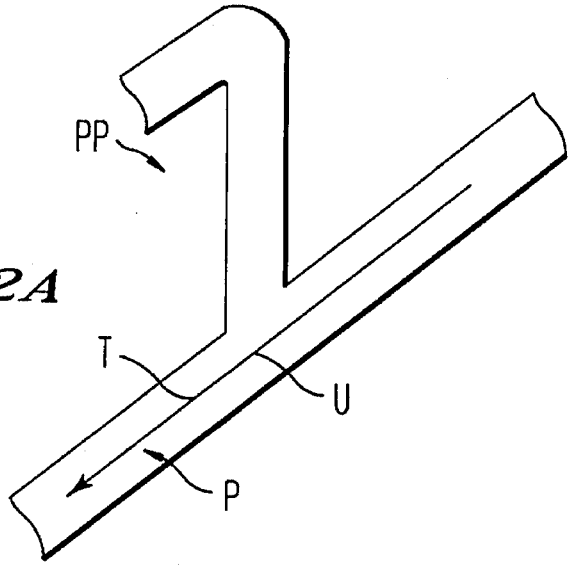
FIGS. 2A–2C illustrate the general functions of diverting a page performed by the invention.
Figure 2B:
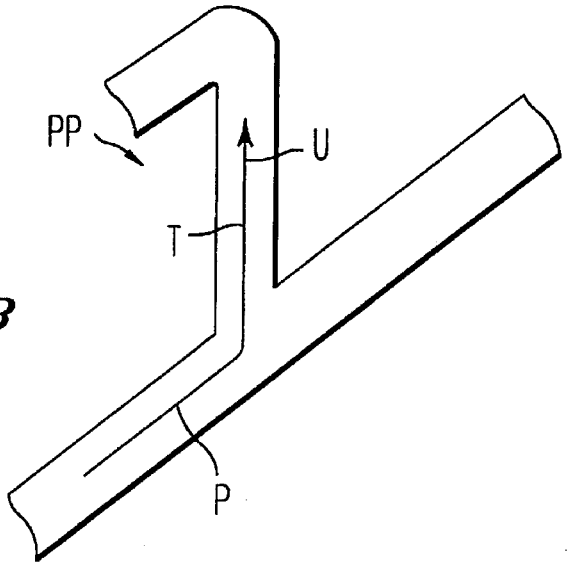
Figure 2C:
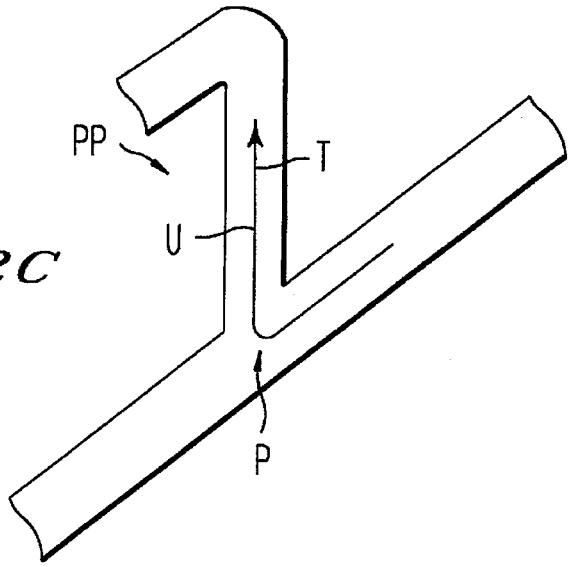

Referring now to the drawings, wherein like reference numerals designate identical or corresponding parts throughout the several views, and more particularly to FIGS. 2A–2C thereof, there are illustrated the general functions of diverting a page along different paths performed by the invention. In FIG. 2A, the paper path is generally designated by PP. There is a page P traveling in a direction which is downward and to the left having its top-side T facing upwardly and its under-side U facing downwardly. As the page P travels downwardly in FIG. 2A, the page follows essentially a straight paper path.

In FIG. 2B, the page is traveling in a direction which is opposite to the direction the page is traveling in FIG. 2A. As the page is traveling rightwardly, the page is directed along the vertically oriented section of the paper path.

In FIG. 2C, as the page P travels in a leftward direction, it is directed upwardly along the vertical section of the paper path. By comparing the orientation of the page in FIGS. 2B and 2C, it can be seen that the positioning of the top-side and under-side of the page in these two figures is reversed. Therefore, the page P can be advanced leftwardly as illustrated in FIG. 2A, stopped, and its direction of travel reversed and directed upwardly as illustrated in FIG. 2B in order to have the final orientation of the page in FIG. 2B different from the final orientation of the page in FIG. 2C. The present invention is a mechanism for directing, diverting and inverting pages so that the pages follow various paths such as are illustrated in FIGS. 2A–2C.

Figure 3:
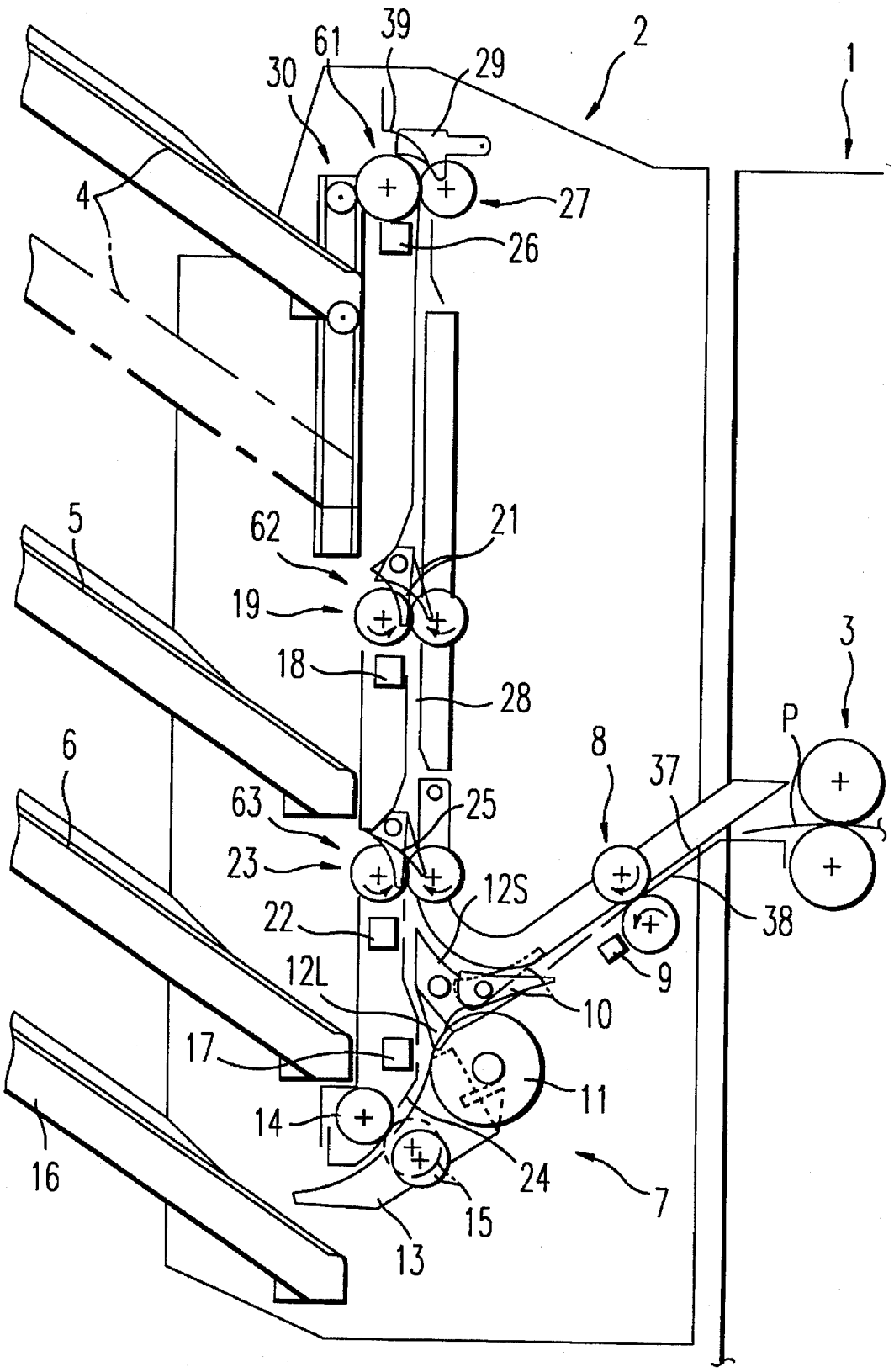
FIG. 3 illustrates a document sorter containing a document reversal mechanism of the present invention.

FIG. 3 illustrates a sorter 2 disposed beside an ejecting portion of an image forming apparatus 1 such as a copier, printer, facsimile, or other device which processes pages. A page or sheet P of paper or other thin material such as cardboard or sheet metal exits the image forming apparatus 1 via a pair of rollers 3. An upper guide 37 and a lower guide 38 are disposed in the sorter 2 through which the page P travels. The page P travels to any one of the paper trays or bins 4, 5, 6 and 16 which hold ejected pages without being inverted when the direction of travel of the page is not changed. However, a page inverter or switch-back device 7 may be used to invert the paper and transfer the paper to trays 6, 5, or 4, as will be explained in detail later.

A pair of rollers 8 rotating in a direction as illustrated feed the page forward past a detecting sensor 9 and to a switching guide 10 which is pivotally mounted and changes from the positions illustrated using the solid and dotted lines. If the switching guide 10 is positioned as illustrated by the solid line, the page P is directed to one of the bins 4, 5 and 6 without being inverted. In contrast, if the switching guide 10 is positioned as illustrated using the dotted line, the page P is either inverted using the inverting device 7 or directed to paper tray 16 without being inverted.

When the page is directed upwardly by the switching guide 10, the page is directed to a vertical path 28 disposed in the sorter 2 along a switching guide 12 including long guide members 12L and short guide members 12S, and ultimately ejected into one of the paper trays 4, 5, and 6. The tray 6 has a corresponding pair of ejecting rollers 23, an ejecting gate 25, an ejection outlet 63, and an ejecting sensor 22. The tray 5 includes a corresponding pair of ejecting rollers 19, an ejecting gate 21, an ejection outlet 62, and an ejecting sensor 18. The bin or paper tray 4 has a corresponding pair of ejecting rollers 27, an ejecting guide 29 which curls the paper in order to give it rigidity, a paper guide 39 to direct page to the tray 4, an ejection outlet 61 out of which the page exits, and an ejecting sensor 26.

The tray 4 includes an elevational mechanism 30 for keeping the stack of paper in the tray 4 at a preferable level. The tray 4 lowers from the position illustrated using solid lines as more paper is placed in the tray. As paper is piled into tray 4 or any of the other trays, the tray is automatically moved after each set of papers are placed in the tray using known doggy tail mechanisms in order to group the ejected paper in offset stacks.

Figure 4:
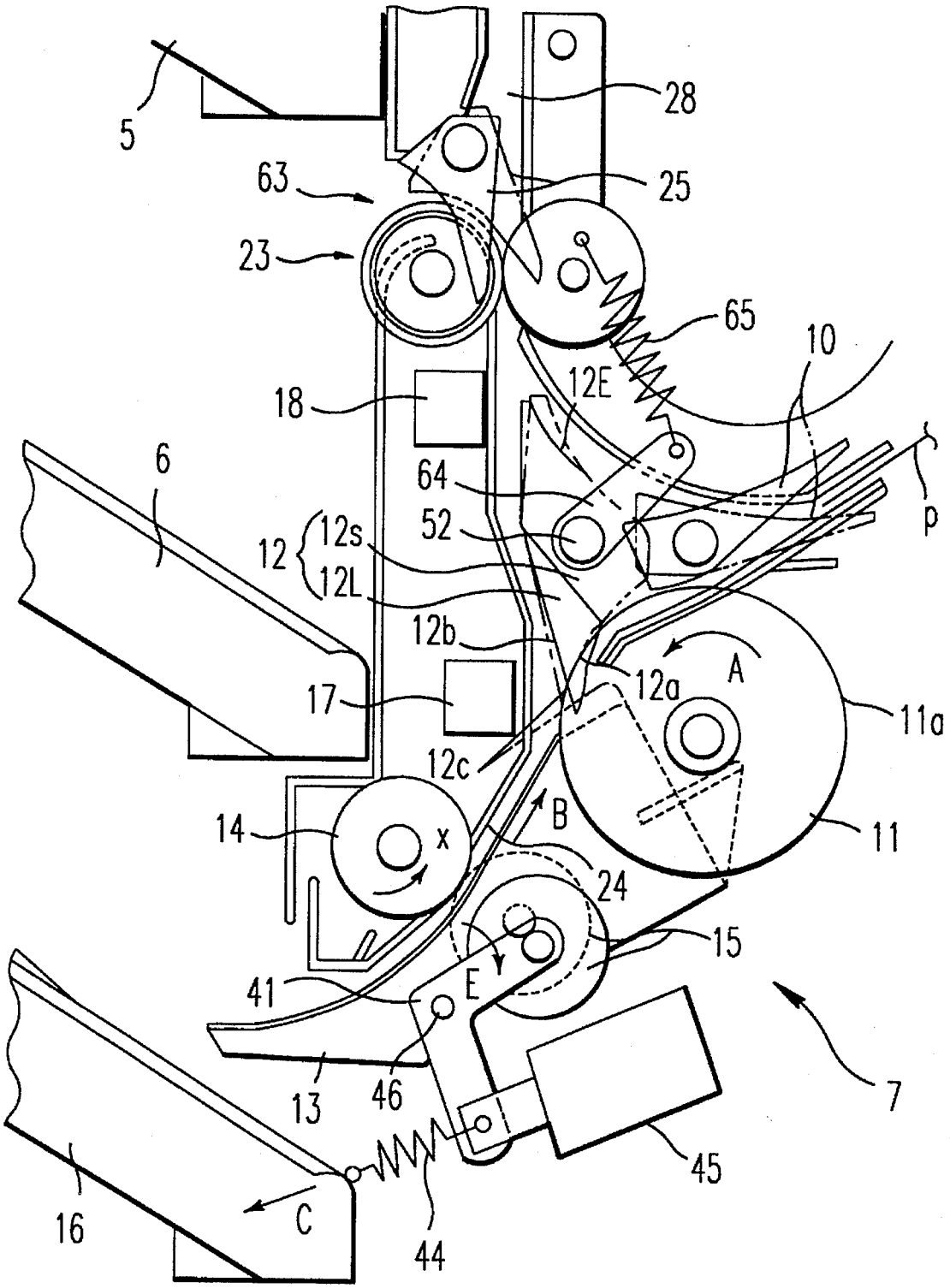
FIG. 4 is a detailed cross-sectional illustration of the page inverting mechanism of the present invention.

FIG. 4 illustrates a detailed cross-sectional view of the paper inverting device 7. The feeding roller 11 continuously rotates in the direction illustrated by the arrow A. There is a reverse feeding roller 14 rotating in a direction X which is opposite to the rotating direction of the feeding roller 11. A pressing roller 15 is swingably disposed adjacent to the reverse feeding roller 14. The pressing roller 15 is fixed to an end of an L-shaped lever 41 pivotably mounted at axis 46. A spring 44 pulls the lever 41 and consequently the pressing roller 15 away from the reverse feeding roller 14 and a solenoid 45 works against the spring 44 in order to bring the pressing roller 15 against the reverse feeding roller 14. When the solenoid 45 is not engaged, the pressing roller 15 is in the position illustrated using the solid line due to the force exerted by the spring 44, and when the solenoid 45 is engaged, the pressing roller 15 moves to the position illustrated using a broken line. A guide 13 is used to guide the page along the paper path after passing rollers 14 and 15.

Figure 6:
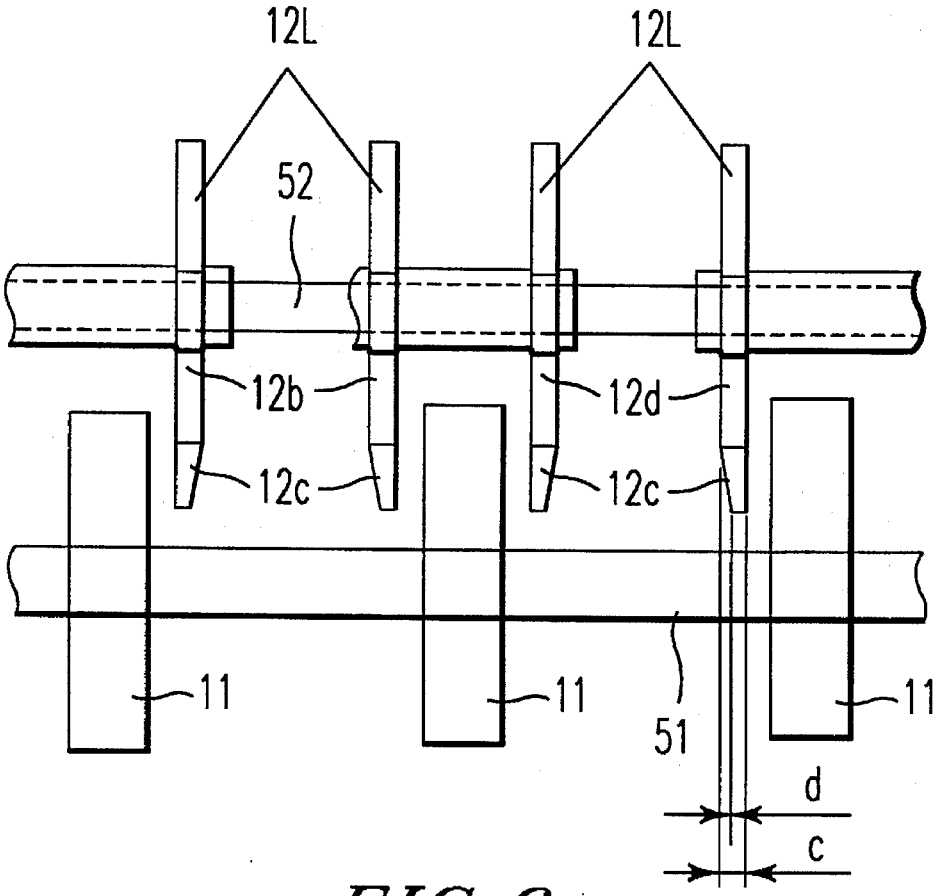
FIG. 6 is a longitudinal view of the switching guide and feeding rollers.
Figure 7:
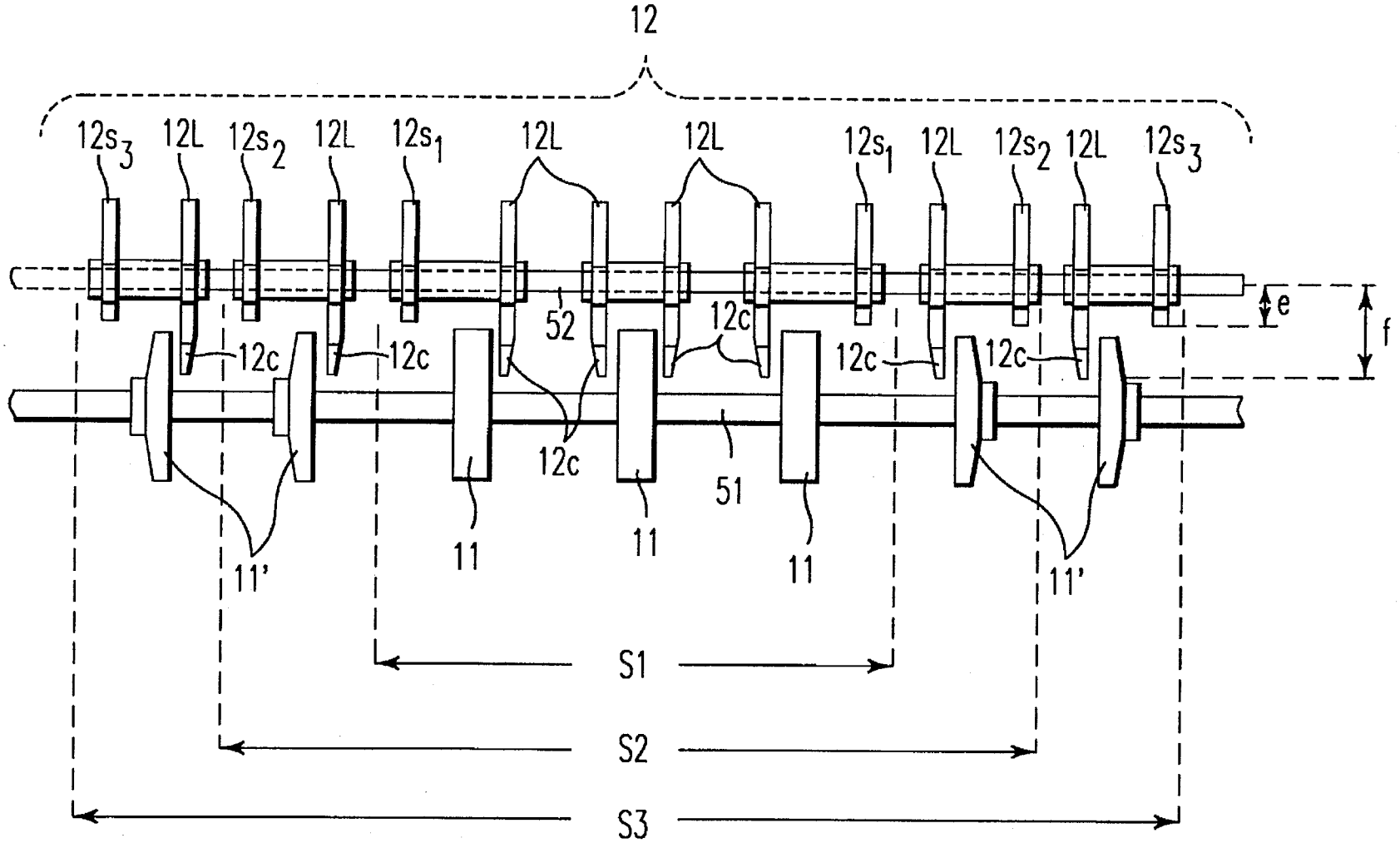
FIG. 7 is a more detailed view of the switching guide and feeding rollers.

The paper inverting device 7 includes a switching guide 12. The switching guide 12 illustrated in FIG. 4 is a cross-sectional view and the longitudinal views of FIGS. 6 and 7 illustrate a plurality of long and short guide elements 12L and 12S making up the switching guide and a plurality of feeding rollers 11 and 11' making up the feeding roller 11. The feeding rollers 11' have a different thickness than the feeding rollers 11, as illustrated in FIG. 7. The axis of the switching guide 12 and feeding rollers are parallel to each other. As seen in FIGS. 6 and 7, as the guide members making up the switching guides are not directly aligned with the feeding rollers 11 and 11', the guide members move between the feeding rollers. As illustrated in FIG. 4, the switching guide 12 is mounted to an axis 52. Also mounted to the pivot axis 52 is a lever 64 secured to a stationary point of the ejection mechanism 2 with a spring 65. Without a page present between the roller 11 and guide element 12, the spring 65 will rotate the switching guide 12 to the position illustrated using solid lines in FIG. 4 so that the surface **12*c* of the guide elements making up the switching guide 12 are closer to the axis of the rollers 11 than the distance of the outer periphery 11*a* of the rollers to their axis. When a page is between the switching guide 12 and roller 11, the page will move the switching guide 12 to the position illustrated using broken lines against the force of the spring 65**.

Figure 5:
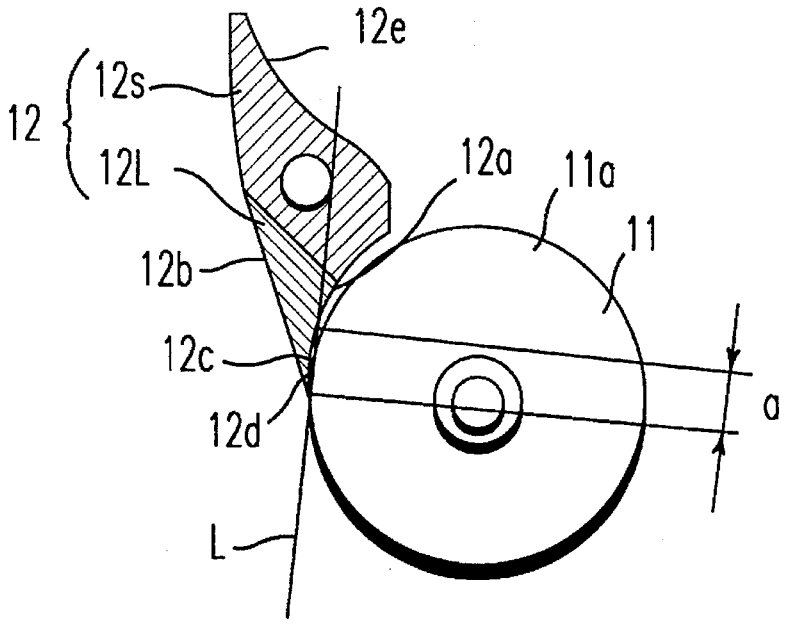
FIG. 5 is a cross-sectional view of a feeding roller and switching guide.

Turning to FIG. 5 for a detailed cross-sectional view of just the switching guide 12 and the feeding roller 11, the guide elements 12S and 12L of the switching guide have three surfaces for guiding pages. A first surface including **12*a* and 12*b* is used to guide a page downward to the left (as illustrated in FIGS. 4 and 5) towards the reversing roller 14. A second surface including 12*c* and 12*b* is used for guiding a page traveling upwardly from the area of the reverse feeding roller 14, ultimately to one of the ejecting trays 4, 5, or 6 after the direction of travel of the page has been reversed, and a third surface 12*e* is used to guide pages upwardly without being inverted by the paper inverting device 7. There is a tangential line L illustrated which is tangent to the periphery 11*a* of the feeding roller 11 when the guide element 12 is lifted by the paper P when passing between the feeding roller 11 and the switching guide 12. Along this line L, on the surface 12*a* of the switching guide 12, the surface 12*d* of the switching guides 12L** is flat for the length 'a'.

A feature of the switching guide 12 is the use of both long guide elements 12L and short guide elements 12S. In FIG. 5, the short guide element 12S is illustrated using horizontal cross hatching and the long guide element, partially hidden behind the short guide element 12S, is illustrated using vertical hatching. If the short guide element 12S were removed from the illustration in FIG. 5, the long guide element 12L would occupy the space of both the horizontal and vertical hatching illustrated in FIG. 5.

The arrangements of the long and short guide elements are illustrated in FIG. 7. In FIG. 7, the switching guide 12 includes two short outer guide elements $12S_3$, two middle short guide elements $12S_2$, and two inner short guide elements $12S_1$. The purpose of the short guide elements 12S is to reduce the contact pressure between the edges of different size pages and the short guide elements 12S. In FIG. 7, three different paper sizes S1, S2, and S3 are illustrated. Each of the different paper sizes is illustrated as being centered with respect to the switching guide 12. The edges of paper size S1 are near the short guide elements $12S_1$. Similarly, the edges of paper size S2 are near the short guide elements $12S_2$ and the edges of paper size S3 are near the short guide elements $12S_3$. It is to be noted that the sizes S1, S2, and S3 can correspond to any paper size oriented either in a portrait or landscape format. In FIG. 7, the length 'e' from the axis to the edge of the short guide elements 12S is approximately 15 mm while the length 'f' from the axis to the end of the long guide elements 12L is approximately 30 mm.

Figure 8:
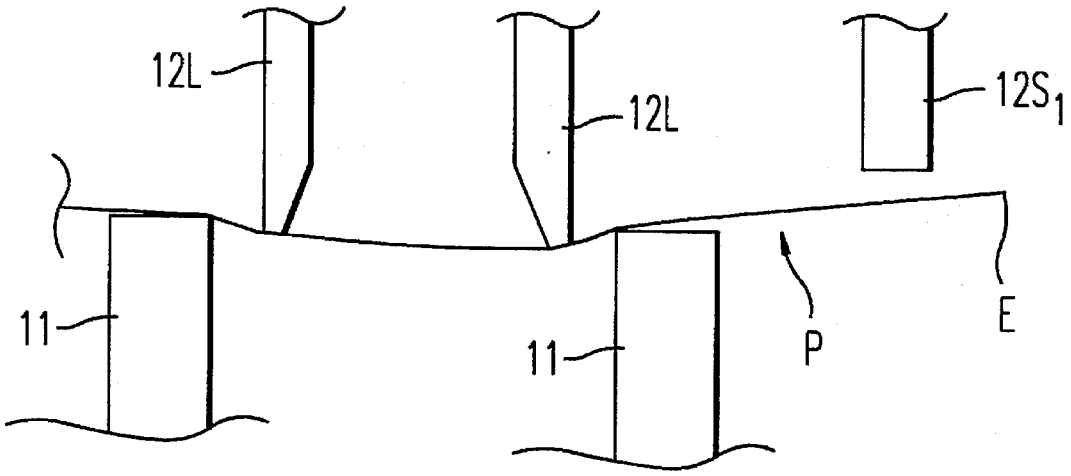
FIG. 8 illustrates a page within the switching mechanism of the invention.

FIG. 8 illustrates (not to scale) an example of the functioning of the long and short guide elements with the rollers 11. The page P is illustrated as contacting the rollers 11 due to pressure exerted by the long guide elements 12L. However, it can be seen that the edge E of the page has no contact with the short guide element $12S_1$ and therefore, the friction at the edge of the page is reduced, thus reducing the number of paper jams. Of course it is possible for the short guide elements 12S either to contact the page P with reduced pressure or not contact the page P (as illustrated) during use.

Another feature of the switching guide 12 is the tapered ends 12*c* of the long guide elements 12L. In FIG. 6, the largest thickness of the guide element 12L is marked with distance 'c' which is approximately 3 mm. The distance 'd' which is the shortest width of the portion 12*c* of the guide elements 12L is approximately 1.5 mm. The distance from the bottom tip of the guide elements 12L to the point where the taper begins is approximately 5 to 6 mm. By tapering the portion 12*c* of the guide elements 12L, the contact area of the edge 12*c* to a page is reduced, which reduces the resistance the guide 12 has on a page. FIG. 8 clearly illustrates the reduced contact area that the taper portion of the guide elements 12L has with the page P. In addition to the thickness of 12*c* being narrower than the thickness of the surface 12*b*, the thickness of 12*c* is also smaller than the thickness of the surface 12*a*.

The operation of the inverting device 7 will now be explained when a page is inverted and ejected to one of the ejecting trays 4, 5, or 6. As shown in FIG. 3, a page P is ejected from the device 1 and fed by the pair of rollers 8 between the upper guide 37 and lower guide 38. The peripheral speed of the rollers 8 is equal to or higher than the peripheral speed of the rollers 3. After the trailing edge of the page P passes the rollers 3, the rotational speed of the inlet rollers is increased so that the intervals between successively fed pages are increased. The rotational speed of the inlet rollers 8 is reduced back to its former speed before the next page reaches the inlet rollers 8.

The switching guide 10 is positioned to direct the page P downwardly and to the left as illustrated using a broken line in FIG. 3 and using a solid line in FIG. 4. The page P then enters the space between the switching guide 12 and the feeding roller 11. As previously discussed, the lower part 12*c* of the guide elements overlaps the periphery 11*a* of the feeding roller 11 under the force applied to the switching guide by the spring 65. The page is then fed into the switch back path after passing between the switching guide 12 and the roller 11.

After the page P passes between the switching guide 12 and the roller 11, the switch guide 12 returns to the position illustrated using a solid line in FIG. 4. At this time, the page P stops after passing the feeding roller 11 as no rollers influence the page at this time. In the illustrated embodiment, a portion of the page P will be ejected out of the path 24 and onto the tray 16. At this time, sensor 17 detects the trailing edge of the page P and the solenoid 45 is energized after a predetermined delay time. The energized solenoid pulls the lever 41 in a direction opposite to the arrow E so that the roller 45 moves towards the roller 14 against the bias of the spring 44 having a direction C. The page P is wedged between the roller 14 rotating in the direction X and the roller 15 which causes the page to move upwardly against the surface 12*c* and 12*b* of the switching guide 12 into the vertical path 28 in the direction labeled B.

The structure and function of the switching guide 12 and its interaction with the feeding roller 11 allows the direction in which the pages travel to be reversed and the pages to be inverted. The force of the spring 65 is predetermined and not set too high so that the paper entering between the feeding roller 11 and switching guide 12 does not encounter too much resistance. Also as explained above, use of long and short guide elements 12S and 12L reduces the resistance on the page, especially at the edge portions of the page. The tapering of the long guide elements 12L also reduces resistance on the paper due to a reduced contact size between the page and long guide elements 12L. Because the edge 12*c* of the inverting guide is positioned in an overlapping manner to the periphery 11*a* of the feeding roller 11 and the width of the edge 12*c* is gradually tapered, the feeding of the paper is accomplished in a smooth manner. The use of the switching guide 12 in conjunction with the feeding roller 11 when constructed according to the teachings of the present invention eliminates essentially all paper jams caused by the inverting device. In contrast, conventional inverting mechanisms can jam once for every 100 pages that are inverted.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A diverting mechanism, comprising:

a switching guide pivotally mounted on a first axis, the switching guide including a plurality of switching elements including a plurality of first size switching elements and a plurality of second size switching elements which are smaller than the first size switching elements; and a plurality of rollers mounted on a second axis which is parallel to the first axis, wherein:

a sheet traveling in a first path in a first direction passes between the plurality of rollers and the switching elements; and the sheet traveling in the first path in a second direction opposite to the first direction is directed to a second path different than the first path by the switching elements.

2. A diverting mechanism according to claim 1, wherein:

ends of the first size switching elements extend closer to the second axis than a distance from ends of the second size switching elements to the second axis.

3. A diverting mechanism according to claim 2, wherein:

when the sheet is between the plurality of rollers and the switching elements, the second size switching elements exert less pressure on the sheet than the first size switching elements due to the smaller size of the second size switching elements.

4. A diverting mechanism according to claim 2, wherein:

at least two of the second size switching elements are located proximate to and correspond with edges of the sheet when the sheet is between the rollers and the switching elements.

5. A diverting mechanism according to claim 2, further comprising:

a spring which biases the switching guide to pivot so that ends of the first size switching elements are closer to the second axis than a distance from an outer periphery of the rollers to the second axis, wherein when the sheet passes between the plurality of rollers and the switching element, the sheet pivots the plurality of guide elements on the first axis and moves ends of the plurality of guide elements away from the second axis.

6. A diverting mechanism according to claim 1, wherein:

ends of the first size switching elements closest to a periphery of the rollers are smaller in width than widths of other portions of the first size switching elements.

7. A diverting mechanism according to claim 6, wherein:

said ends of the first size switching elements are tapered.

8. A diverting mechanism according to claim 7, wherein:

said ends of the first size switching elements are tapered in order to reduce a resistance imparted onto a movement of said sheet by said first size switching elements.

9. A diverting mechanism according to claim 7, wherein:

said ends of the first size switching elements include straight portions which are substantially tangent to a point of the periphery of the rollers closest to said ends of the first size switching elements when the sheet is between the rollers and the switching guide.

10. A diverting mechanism according to claim 1, further comprising:

a diverter Which directs the sheet traveling in the first path in the first direction to the second path, before the sheet passes between the switching guide and the rollers; and a set of rollers which move the sheet in the second direction from the first path to the second path.

11. A diverting mechanism according to claim 10, wherein:

a sheet in the second path which is diverted by said diverter has an orientation which has a front and back of the sheet reversed compared to if the sheet would have passed between the switching guide and the plurality of rollers, and then advanced by said set of rollers in the second direction to the second path.

12. A diverting mechanism, comprising:

a plurality of rollers mounted on a first axis;

a switching guide pivotally mounted on a second axis which is parallel to the first axis, the switching guide including a plurality of switching elements having ends closest to a periphery of the rollers which are smaller in width in a direction parallel to the second axis than other portions of the switching elements, wherein:

a sheet traveling in a first path in a first direction passes between the plurality of rollers and the switching elements; and the sheet traveling in the first path in a second direction opposite to the first direction is directed to a second path different than the first path by the switching elements.

13. A diverting mechanism according to claim 12, wherein:

said ends of the plurality of switching elements are tapered.

14. A diverting mechanism according to claim 13, wherein:

said ends of the plurality of switching elements are tapered in order to reduce a resistance imparted onto a movement of said sheet by said plurality of switching elements.

15. A diverting mechanism according to claim 12, further comprising:

a diverter which directs the sheet traveling in the first path in the first direction to the second path, before the sheet passes between the switching guide and the rollers; and a set of rollers which move the sheet in the second direction from the first path to the second path.

16. A diverting mechanism according to claim 15, wherein:

a sheet in the second path which is diverted by said diverter has an orientation which has a front and back of the sheet reversed compared to if the Sheet would have passed between the switching guide and the plurality of rollers, and then advanced by said set of rollers in the second direction to the second path.

17. A diverting mechanism, comprising:

a plurality of rollers mounted on a first axis;

a switching guide pivotally mounted on a second axis which is parallel to the first axis, the switching guide including a plurality of switching elements, the switching guide including a means for reducing a resistance of movement of the sheet between the rollers and the switching guide, wherein:

a sheet traveling in a first path in a first direction passes between the plurality of rollers and the switching elements;

the sheet traveling in the first path in a second direction opposite to the first direction is directed to a second path different than the first path by the switching elements; and the switching elements having ends closest to a periphery of the rollers which are smaller in width in a direction parallel to the second axis than other portions of the switching elements.

18. A diverting mechanism according to claim 17, wherein:

the means for reducing a resistance includes tapered ends of the plurality of switching elements.

19. A diverting mechanism according to claim 17, wherein:

the means for reducing a resistance includes a smaller length of some of said switching elements compared to a length of another of said switching elements.

20. A diverting mechanism according to claim 19, wherein:

the switching elements having the smaller lengths are located at positions where edges of said sheet travel.

21. A diverting mechanism, comprising:

a plurality of rollers mounted on a first axis;

a switching guide pivotally mounted on a second axis which is parallel to the first axis, the switching guide including a plurality of switching elements having ends closest to a periphery of the rollers which are smaller in width than other portions of the switching elements, wherein:

a sheet traveling in a first path in a first direction passes between the plurality of rollers and the switching elements; and the sheet traveling in the first path in a second direction opposite to the first direction is directed to a second path different than the first path by the switching elements, said diverting mechanism further comprising:

a diverter which directs the sheet traveling in the first path in the first direction to the second path, before the sheet passes between the switching guide and the rollers; and a set of rollers which move the sheet in the second direction from the first path to the second path.

22. A diverting mechanism according to claim 21, wherein a sheet in the second path which is diverted by said diverter has an orientation which has a front and back of the sheet reversed compared to if the sheet would have passed between the switching guide and the plurality of rollers, and then advanced by said set of rollers in the second direction to the second path.

23. A diverting mechanism, comprising:

a plurality of rollers mounted on a first axis;

a switching guide pivotally mounted on a second axis which is parallel to the first axis, the switching guide including a plurality of switching elements, the switching guide including a means for reducing a resistance of movement of the sheet between the rollers and the switching guide, wherein:

a sheet traveling in a first path in a first direction passes between the plurality of rollers and the switching elements;

the sheet traveling in the first path in a second direction opposite to the first direction is directed to a second path different than the first path by the switching elements; and the means for reducing a resistance includes a smaller length of some of said switching elements compared to a length of another of said switching elements.

24. A diverting mechanism according to claim 23, wherein:

the switching elements having the smaller lengths are located at positions where edges of said sheet travel.

* * * * *